US009187200B2

(12) United States Patent
Marovic et al.

(10) Patent No.: US 9,187,200 B2
(45) Date of Patent: Nov. 17, 2015

(54) APPARATUS FOR THE HANDLING OF MULTIWALL BAGS CONTAINING POWDERED OR PARTICULATE MATERIAL

(75) Inventors: Ivan Marovic, Hamilton (NZ); Jack Pennington, Hamilton (NZ)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 765 days.

(21) Appl. No.: 13/505,046

(22) PCT Filed: Oct. 20, 2010

(86) PCT No.: PCT/NZ2010/000210

§ 371 (c)(1),
(2), (4) Date: Apr. 30, 2012

(87) PCT Pub. No.: WO2011/053165

PCT Pub. Date: May 5, 2011

(65) Prior Publication Data

US 2012/0213620 A1 Aug. 23, 2012

(30) Foreign Application Priority Data

Oct. 30, 2009 (NZ) ..... 580858

(51) Int. Cl.

| | |
|---|---|
| ***B65B 69/00*** | (2006.01) |
| ***B65D 30/08*** | (2006.01) |
| ***B65D 33/22*** | (2006.01) |

(52) U.S. Cl.

CPC ..... *B65B 69/0008* (2013.01); *B65D 31/02* (2013.01); *B65D 33/22* (2013.01)

(58) Field of Classification Search

CPC ..... B65B 69/0008; B65B 69/0025; B65B 69/0033; B65G 59/065; B65G 2201/0238; B65G 41/002; B65D 33/32; B65D 31/02; B65D 33/22

USPC ..... 414/412

See application file for complete search history.

(56) References Cited

U.S. PATENT DOCUMENTS 2,505,289 A * 4/1950 Haslett ..... 294/93
3,782,305 A * 1/1974 Robinette ..... 112/10

(Continued)

FOREIGN PATENT DOCUMENTS

FR 2 578 809 A1 9/1986
NZ 335620 9/2000

(Continued)

OTHER PUBLICATIONS

International Search Report (PCT/ISA/210) issued on Dec. 22, 2010, by Australian Patent Office as the International Searching Authority for International Application No. PCT/NZ2010/000210.

(Continued)

*Primary Examiner* — Glenn Myers

(74) *Attorney, Agent, or Firm* — Buchanan Ingersoll & Rooney PC

(57) ABSTRACT

An apparatus to facilitate the handling of multi-wall bags containing powdered or particular material or product, more specifically but not limited to the emptying of ex factory bags containing milk powder for further processing in a sterile manner. The apparatus includes an outer bag slitting station, an outer and inner bag separating device and an inner bag slitting station incorporating a tilting table to convey the slit inner bag to a powder receiving hopper.

14 Claims, 10 Drawing Sheets

(56) References Cited

U.S. PATENT DOCUMENTS

| | | | | |
|---|---|---|---|---|
| 4,134,508 | A | 1/1979 | Burdett, Jr. | |
| 4,439,101 | A * | 3/1984 | Orlowski et al. | 414/795.6 |
| 4,527,716 | A * | 7/1985 | Haas et al. | 222/83.5 |
| 5,188,504 | A * | 2/1993 | Nelson | 414/810 |
| 5,442,895 | A * | 8/1995 | Linson | 53/381.2 |
| 5,870,886 | A * | 2/1999 | Norton | 53/492 |
| 5,958,336 | A * | 9/1999 | Duarte | 422/24 |
| 6,134,866 | A * | 10/2000 | Schoenewolff et al. | 53/561 |
| 6,964,146 | B2 * | 11/2005 | LaRocca | 53/459 |
| 7,341,416 | B1 | 3/2008 | Rubtsov | |
| 2007/0107176 | A1 * | 5/2007 | Colson et al. | 29/24.5 |

FOREIGN PATENT DOCUMENTS

| | | | |
|---|---|---|---|
| WO | 2007/021201 | A1 | 2/2007 |
| WO | WO 2008/016313 | A1 | 2/2008 |

OTHER PUBLICATIONS

Extended European Search Report dated Mar. 22, 2013, issued by the European Patent Office in corresponding European Patent Application No. 10827205.5-1708. (6 pages).

* cited by examiner

APPARATUS FOR THE HANDLING OF MULTIWALL BAGS CONTAINING POWDERED OR PARTICULATE MATERIAL

FIELD OF THE INVENTION

This invention relates to an apparatus to facilitate the handling of multi-wall bags containing powdered or particular material or product, more specifically but not limited to the emptying of ex factory bags containing milk powder for further processing.

BACKGROUND

Milk powder ex factory is most often packed in multiwall bags ranging from 10-30 kg, but typically 25 kg in weight that have a multilayer brown (Kraft) paper outer bag for handling strength and a plastic inner liner for powder containment. The bags are sealed using a heat sealer that acts through the paper bag to seal the inner plastic liner. The paper bag is sealed by folding its protruding flap over and re-heating hot melt glue on the underside of the flap. A line of cuts/perforation is scored along the inside of the plastic liner bag to assist separation of the plastic liner from the outer paper bag when this is required. When the bags are constructed, small traces of hot-melt glue are used to fix the inner plastic liner to the outer paper bag in order to assist filling the bag with powder in an automated process.

In order to comply with hygiene requirements, hygienic recovery of the bag contents is required before the product can be further processed into for example infant formula, retail packs or the like. The outer bag which may be contaminated must be removed in a way that maintains the cleanliness of the inner plastic liner bag.

PRIOR ART

To date, various apparatuses are available in use for the emptying of product from bulk bags but these are not focused on recovering the contents in a hygienic manner. Accordingly, the recovery of the product is often an entirely manual operation which requires a greater number of operators; is physically onerous and greatly increases the risk for cross contamination of the product.

AIM OF THE INVENTION

The aim of the invention is to provide an apparatus to facilitate the handling of multi-wall bags containing powdered or particular material or product, more specifically but not limited to the emptying the contents from ex factory bags containing milk powder in a hygienic manner for further processing.

BROAD DESCRIPTION OF THE INVENTION

According to a first broad aspect, the invention provides an apparatus to facilitate the emptying of the contents from a multiwall bag having a paper outer layer(s) and an inner plastic liner containing powdered or particular material or product comprising:

a trimming table station;

a bag separator device associated with said trimming table station;

an outer layer cutter associated with said trimming station;

an inner liner slitting table station;

a transverse slitting blade device associated with said slitting table station; and a hopper station to receive the powdered or particular material or product.

In a preferred embodiment, the trimming table station and the slitting table stations are separated by one or more conveyors; the trimming table station includes a slitting blade device, expediently a rotary device and associated transverse guide rail and is located at one end of the trimming table.

The bag separator device further comprises a spreading arm to engage between the inside surface of the paper layer(s) and outer surface of the inner plastic liner of the multiwall bag; and a pivoting device coupled to the arm.

The transverse slitting blade device of the slitting table station further comprises a sliding blade movable in a transverse direction across the slitting table station and at least two, more preferably three or four rotary blades mounted to cut in a longitudinal direction.

DESCRIPTION OF THE DRAWINGS

In further describing invention by way of a preferred embodiment, reference will be made to the accompanying drawings in which.

DETAILED DESCRIPTION OF PREFERRED EMBODIMENTS OF THE INVENTION

Figure 1:
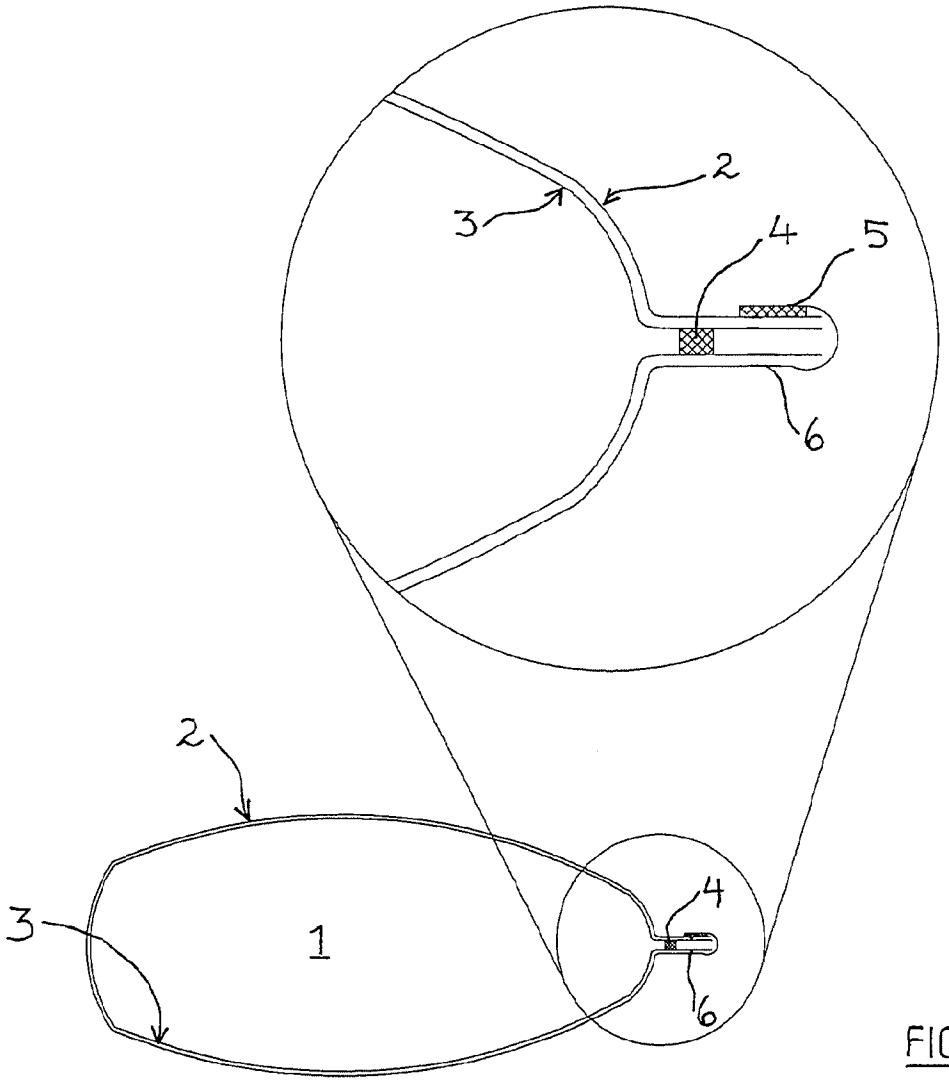
FIG. 1 is a longitudinal cross-sectional view of a multiwall bag containing product.

By way of background, milk powder 1 is most often packed in multiwall bags as shown schematically in FIG. 1 of the drawings that have a multilayer brown paper (Kraft paper) outer bag 2 for handling strength, and a plastic inner liner 3 for powder containment. The bags are sealed using a heat sealer that acts through the paper bag to seal the plastic liner as shown at 4. The outer paper bag 2 is sealed by folding its protruding flap over and re-heating hot melt glue on the underside of the flap 5. A score line 6 is made along the inside of the plastic liner bag to assist separation of the plastic liner 3 from the paper bag 2 when this is required. When the multiwall bags are constructed, small tacks of hot-melt glue are used to fix the plastic liner 3 to the paper bag 2 in order to assist filling the bag with powder in an automated process.

This apparatus facilitates separation the sealed inner plastic liner bag 3 and its contents from the outer paper bag 2 in order that:

- Hygienic recovery of the bag contents is achieved. The outer bag is removed in a way that maintains the cleanliness of the plastic liner bag
- The inner plastic liner bag and seal remains intact in order to contain the powdered product within so that it can be transported to a separate hygienic emptying process.
- The labour content of the process of removing the outer paper bag and subsequently the inner plastic liner bag in order to dump the powder contents is reduced because of more efficient handling of all components.

The drawings disclose two preferred embodiments, like components will be denoted by the same numbers.

Figure 3A:
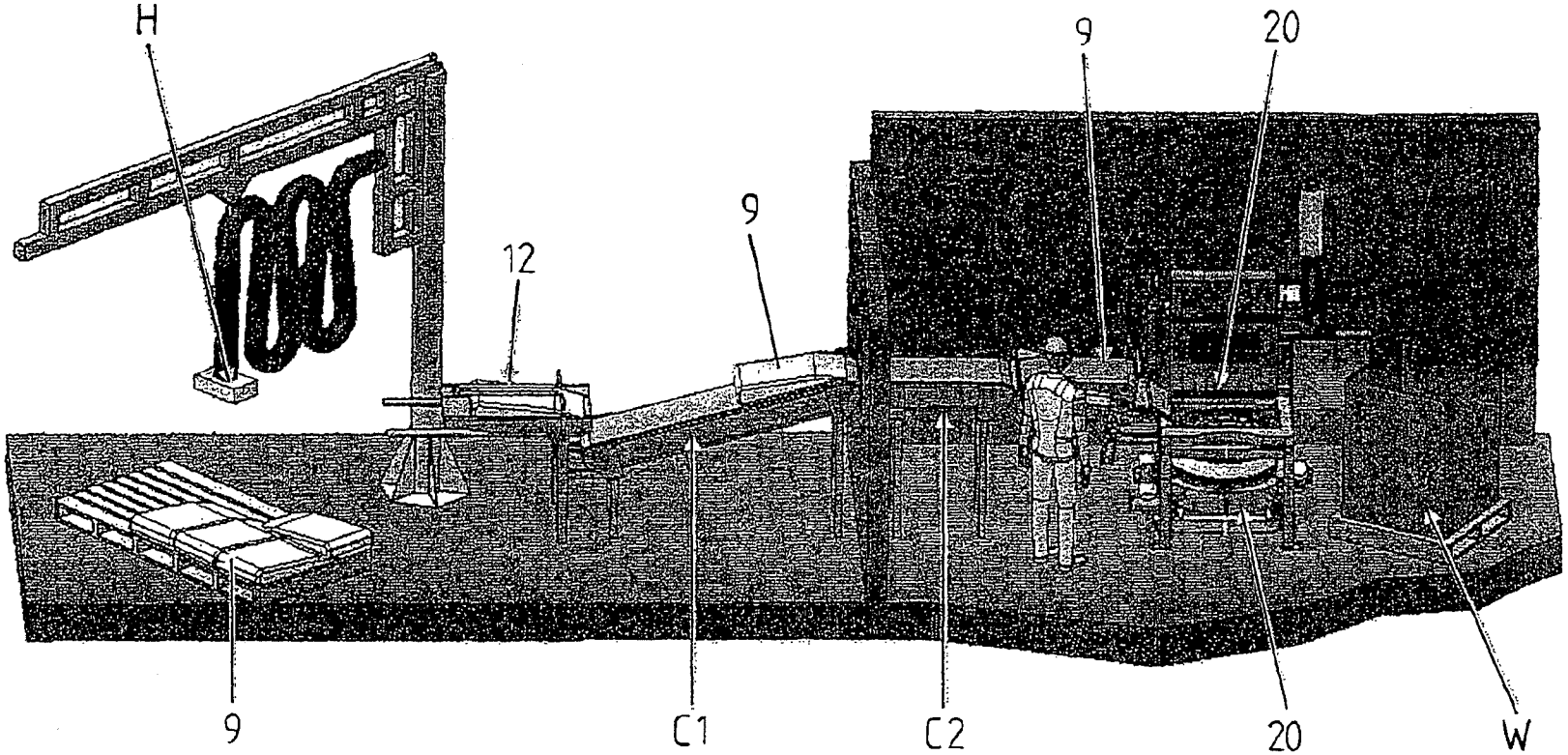
FIGS. 3A, 3B, 3C, 3D and 3E are schematic elevation views of a second embodiment of apparatus at the various stations stages of operation.
Figure 3B:
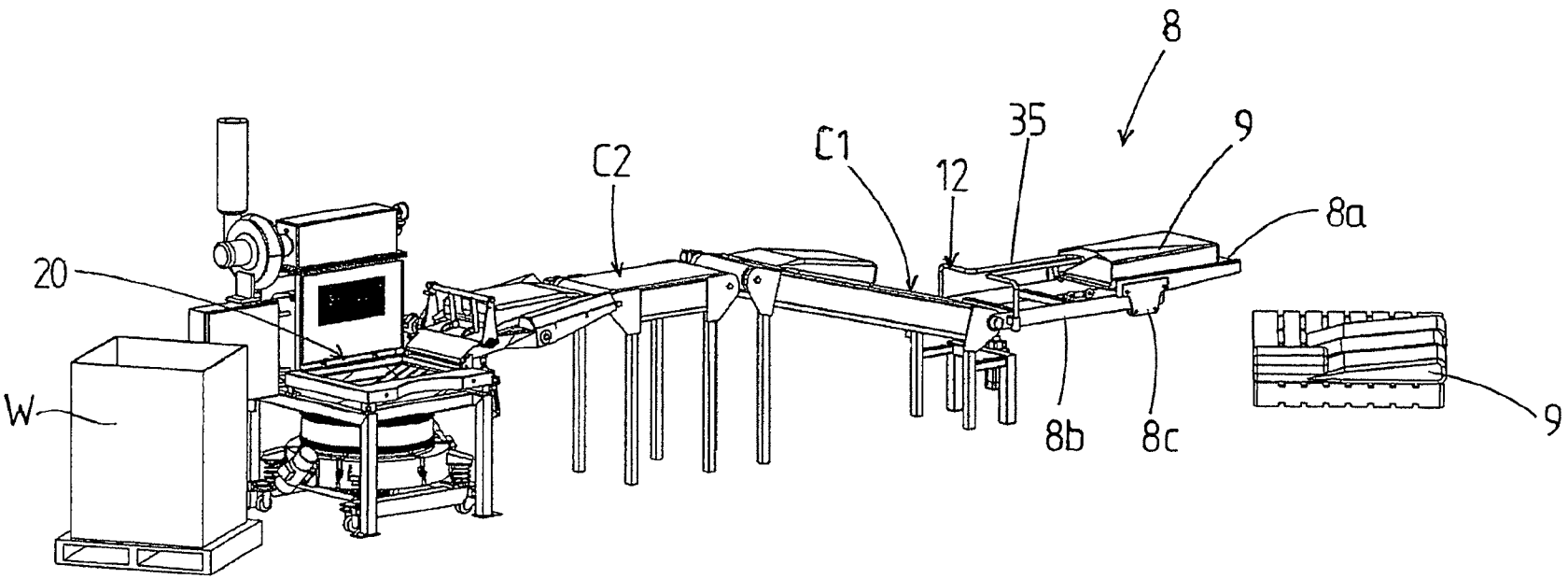
Figure 3C:
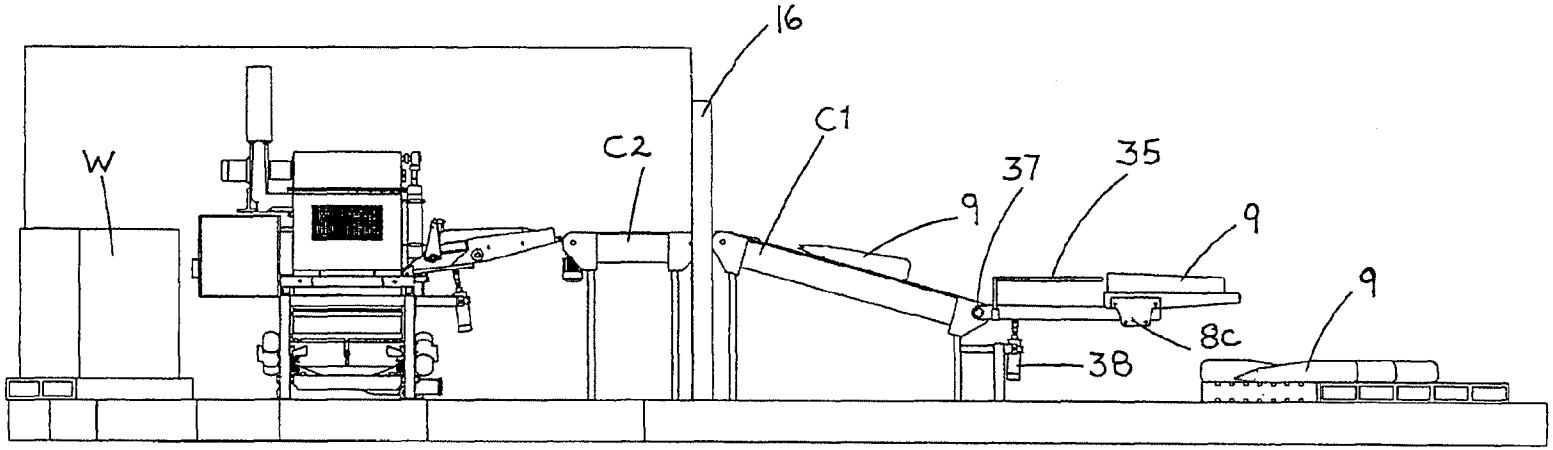
Figure 3D:
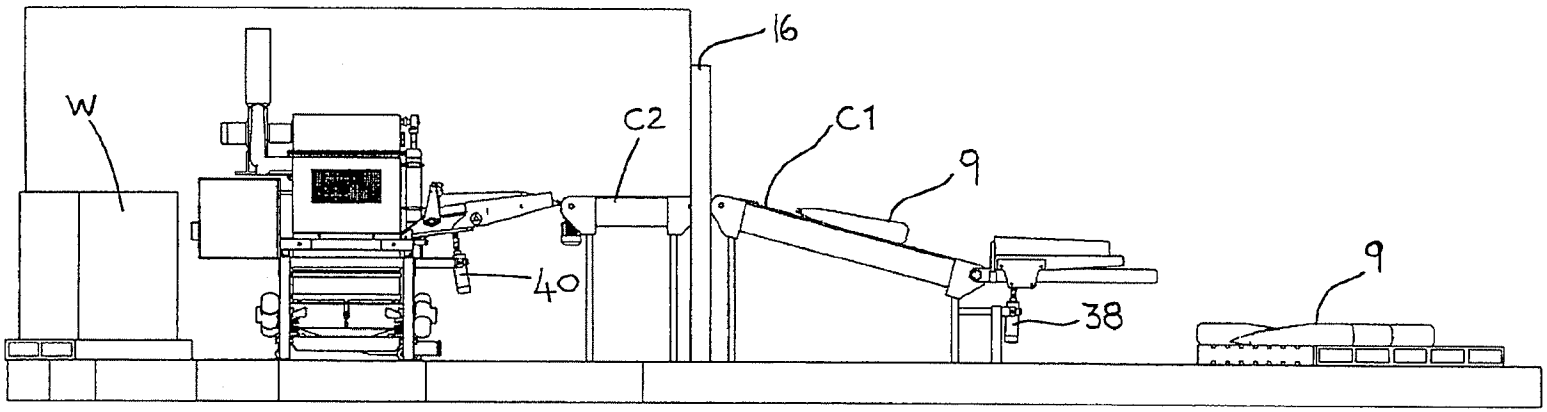
Figure 3E:
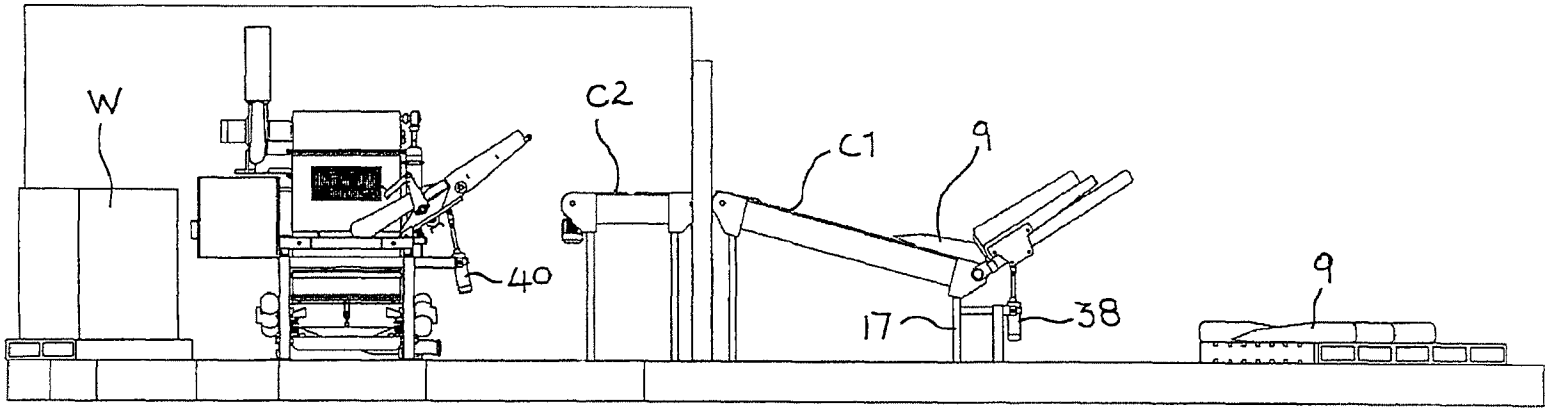

A multiwall bag containing milk powder will be lifted by a first operator onto a trimming table station 8 by use of a conventional vacuum lifting hoist H (FIG. 3A).

Figure 2A:
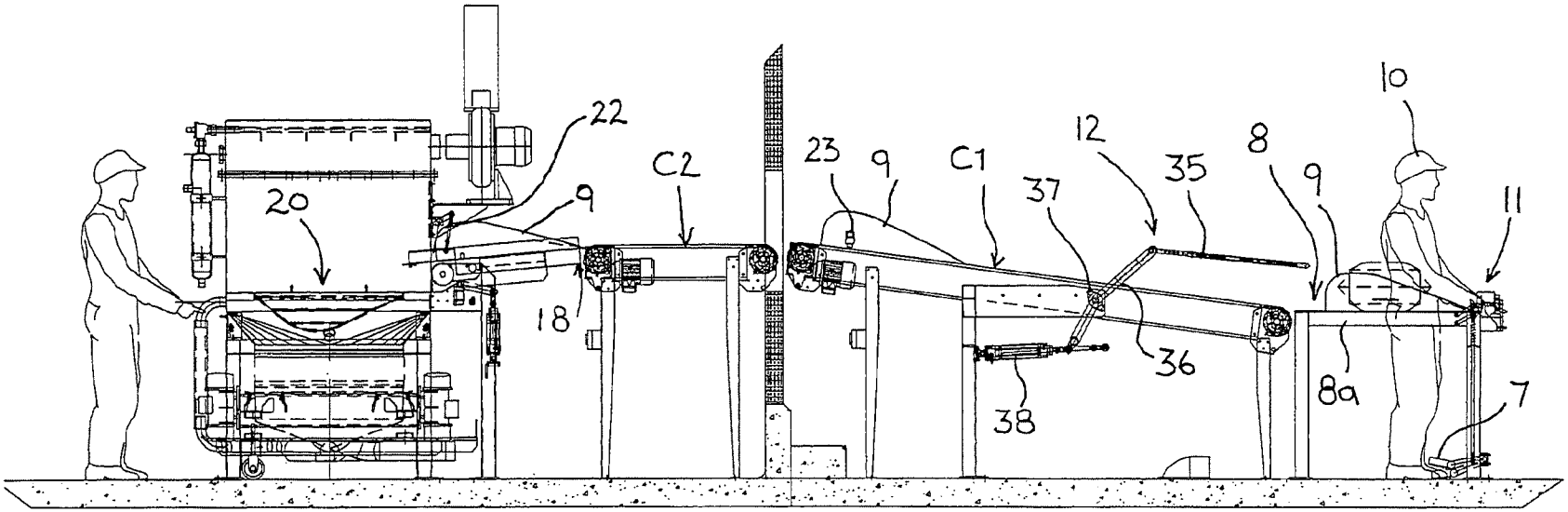
FIGS. 2A, 2B and 2C are schematic elevation views of a first embodiment of apparatus at the various stations stages of operation.
Figure 2B:
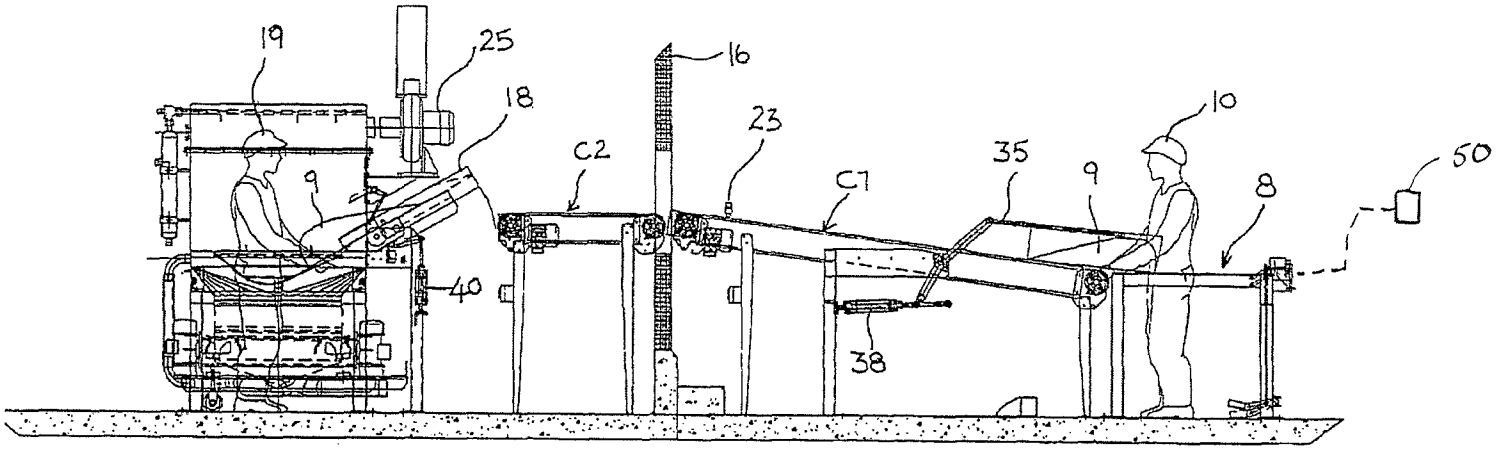

The full bag 9 is rotated by the operator 10 so that its top seal region is presented to rotary cutting device 11 and associated transverse guide rail located at one end of the trimming table 8*a*. The bag 9 is positioned so the cutting device can cut both the paper and the plastic bag tops near the perforated score line 6 and without cutting below the plastic liner seal 4. The trimming station 8 includes a frame having support legs 17 and includes a foot operated clamping jaw 7 (embodiment 1) to securely hold the neck region of the bag prior to trimming. The bag top is cut and removed by the cutter blade 11 action. The cutter blade 11 (outer layer cutter) is driven by a pneumatically operated motor 50 which is schematically illustrated in FIG. 2B. The outer paper bag 2 will now be fully opened showing the sealed plastic liner bag 3 lying inside it.

The bag separator device 12 is associated with a first in-feed conveyor station depicted generally as C1. The separator 12 includes a U-shaped separator bar 35 mounted on a yoke 36 pivotally mounted to the in-feed conveyor frame at 37. A pneumatic ram 38 is affixed to the yoke 36 to effect said pivotal action the purpose of which will be explained.

The bag assembly 9 is rotated through 180° on the trimming table 8*a* facing the in-feed conveyor C1 so that the open paper bag neck end can be presented to the bag separator device 12 as shown at 13 in FIG. 2B. The paper bag neck is held up while the bag is pushed onto the separator bar 35, thus inserting the separator bar between the paper outer bag 2 and the inner plastic liner 3. When the bag separator bar 35 reaches the bottom of the paper bag, the operator will activate the bag separator device, causing ram 38 to tilt the bar 35 upwards as shown at 14 in FIG. 2C. This action retains the outer paper bag 2 while allowing the inner sealed plastic liner bag 3 to slide out of it onto the moving in-feed transport conveyor C1 as shown at 15 of FIG. 2C. The bag separator device 12 is lowered to its start level and the outer paper bag 2 is removed to waste W by the operator 10. The paper bag removal system is thus ready for another cycle. A plastic liner bag containing powder will now wait on conveyor C1 for entry to the bag slitting station table 18.

Figure 2C:
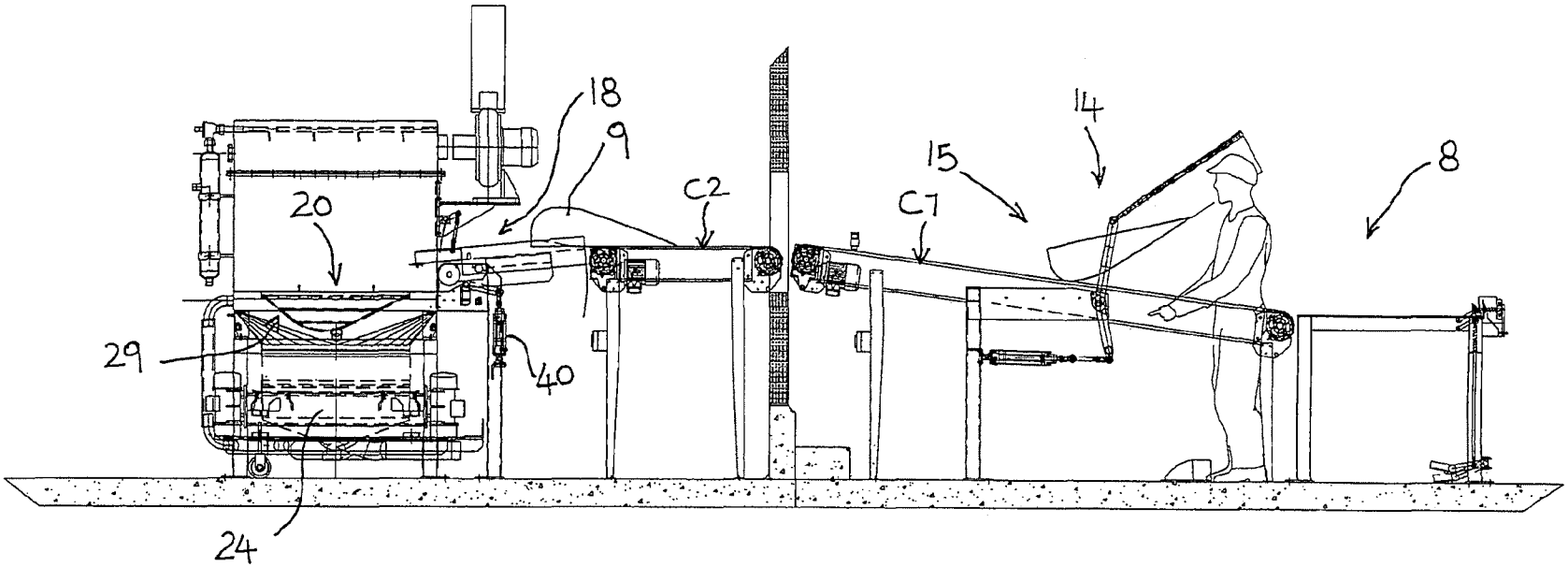

The in-feed transport conveyor C1 carries the plastic liner bag and its contents 9 into a more hygienic processing area behind a barrier wall as schematically depicted by numeral 16 in FIG. 2C.

Figure 2D:
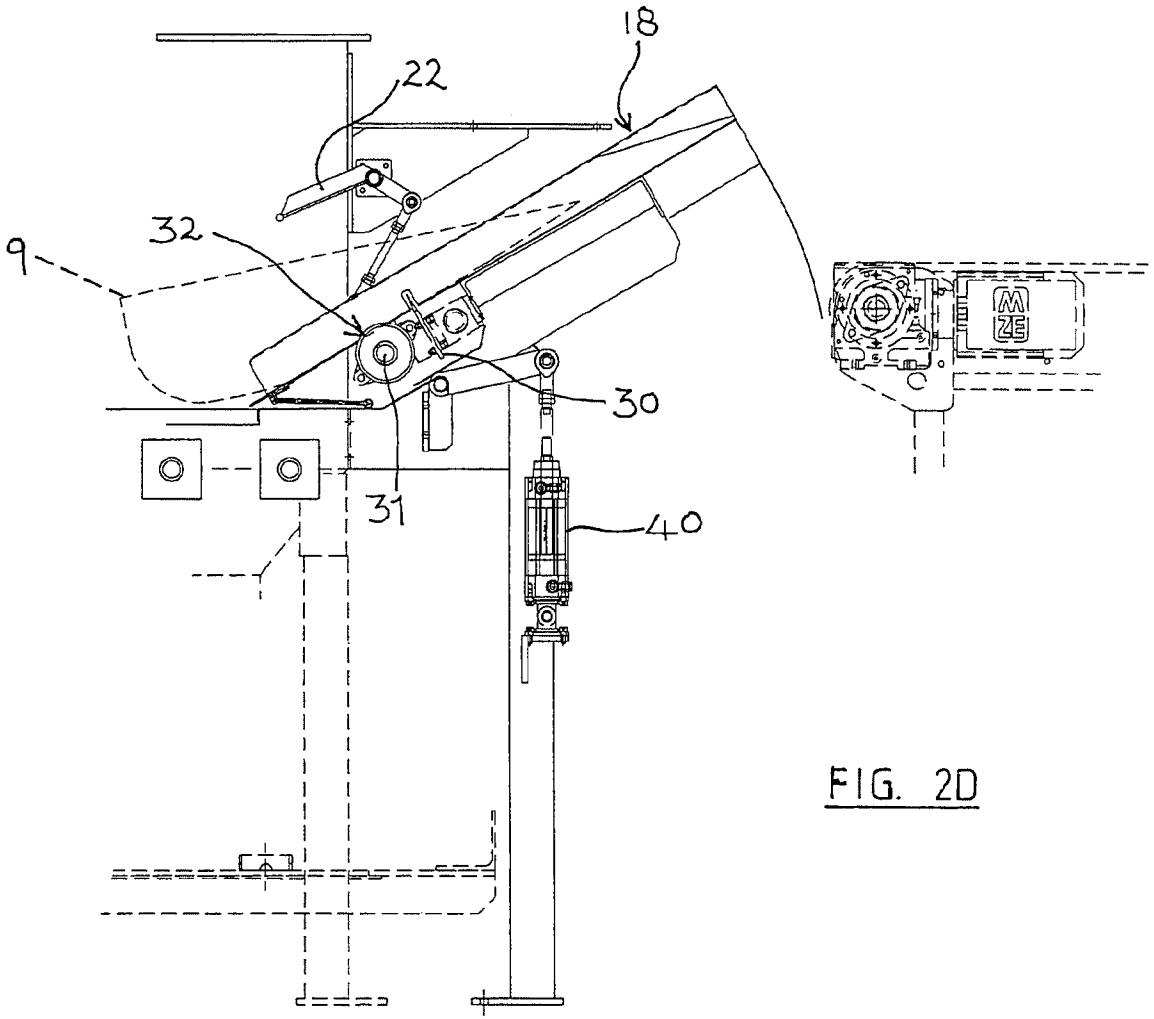
FIG. 2D is an enlarged view of the slitting table station.

A second conveyer station C2 is located immediately behind wall 16 and inline with conveyor C1. This station conveys the bag 9 onto the bag slitting station table 18. Table 18 can be tilted by ram 40 to an inclined position as best shown in FIG. 2D of the drawings. This enables a bag stationed on the table 18 to slide over the slitting knives into the hopper 20 as will be explained hereinafter.

When the bag dump denoted generally by numeral 20 is activated, the sifter 24, the dust collection fan 25 and the powder transport line will activate ready to accept powder.

A second operator 19 requests a plastic bag 9 of powder from conveyor C1 by pressing a button on the second conveyor station C2. The bag moves from conveyor station C1 and is accelerated by conveyor C2 onto the bag slitting station table 18, coming to rest against a retainer bar 22.

Whenever a plastic liner bag 9 is available, it is sensed by photo-eye 23 on in-feed conveyor C1. If the slitter table 18 is in its lowered position, the bag will be automatically transported across conveyor C2 to the slitter table 18.

A plastic bag 9 of powder waiting at barrier 22 is slit and dumped when the operator 19 activates the slitter by pressing a two handed control set. A knife 30 under the slitter table 18 cuts the plastic bag transversely across its width and up to four cutting blades 32 positioned under the slitting table start to rotate via a pneumatic motor 31. The slitter table tilts (FIG. 2D), the barrier 22 lifts (FIG. 2D) and the bag 9 slides into the dump hopper 20 and onto the bag retainer grill 29 over the rotating blades. The bag 9 being slit once across its width and up to four times along its length on its underside, readily discharges its powder content into the bag dump hopper 20. The ribbons of plastic created from the underside of the bag 9 are each retained by being attached to the upper side of the bag proper. The operator 19 is able to empty the plastic bag corners into the dump hopper 20 while ensuring the bag stays above the retainer grid 29. The emptied bag is disposed to waste W. The process continues as long as there is bagged powder to present to the slitter table 18 and the powder transport system remains active.

The sifter 24 can be detached from an inactive bag dump and removed on its own castor wheel set for cleaning.

Referring to embodiment 2 (FIGS. 3A-3E); this arrangement differs in the initial bag handling at the trimming station 8.

As shown in FIG. 3A, an operator uses a vacuum hoist H to lift a bag 9 from a pallet to the trimming table 8*a* which is mounted on a frame having support legs 17. The trimming table 8*a* is supported by a pair of arms 8*b* mounted to the frame for sliding forward and backward motion via sliding carriages 8*c*.

In use, the operator orients the bag 9 such that the neck region faces the spreader bar 35 as previously described for the first embodiment. The table 8*a* is slid back clear of the spreader bar 35 to enable the top to be cut off by rotary cutting device 11 (not shown on FIG. 3A-3D for clarity).

The open bag is lifted over the bag separator bar 35 and both the bag and table 8*a* are slid forward until the separator bar reaches the bottom of the paper bag above the inner liner bag.

The table 8*a* together with bag 9 is pivoted about pivot 37 by the action of pneumatic ram 38 (FIG. 3E) until the liner bag containing the product slides out onto conveyor 1 and the outer paper bag is retained on the spreader bar. The table 8*a* and spreader bar 35 may be retracted to enable the paper bag to be removed to waste W.

It will be appreciated preferred embodiment by way of description only, and the invention is open to modification without departing from the spirit or scope of the invention. In particular, the apparatus could be used for processing other powdered, granular or particulate products that need to be unpackaged in a hygienic and contamination free environment.

The invention claimed is:

1. An apparatus to facilitate the emptying of the contents from a multiwall bag having at least one outer paper layer and an inner plastic liner containing powdered or particular material or product comprising:

a trimming table station;

a bag separator device associated with said trimming table station;

an outer layer cutter device associated with said trimming table station;

an inner liner slitting table station;

a transverse slitting blade device associated with said slitting table station;

a hopper station to receive the powdered or particular material or product; and the bag separator device comprising a spreading bar to engage between the inside surface of the at least one outer paper layer and the outer surface of the inner plastic liner of the multiwall bag, and a pivoting device coupled to the spreading bar.

2. An apparatus according to claim 1, wherein the transverse slitting blade device of the inner liner slitting table station further comprises a sliding blade movable in a transverse direction across the slitting table station and at least two rotary blades mounted to cut in a longitudinal direction.

3. An apparatus according to claim 2, wherein there are at least four rotary blades mounted to cut in a longitudinal direction.

4. An apparatus according to claim 1, wherein the slitting table station further comprises a frame having support legs; and wherein a table of the slitting table station can pivot under the action of a pivoting device to convey a bag the inner plastic liner located thereon to a position over said transverse slitting blade device for slitting; and subsequently to said hopper station for discharge.

5. An apparatus according to claim 4, wherein the pivoting device comprises a pneumatically operated ram.

6. An apparatus according to claim 1, wherein the outer layer cutter device comprises a rotary device and associated transverse guide rail and is located at one end of a trimming table.

7. An apparatus according to claim 1, wherein the spreading bar is substantially u-shaped.

8. An apparatus according to claim 1, wherein the trimming table station further comprises a frame having support legs; a pair of support arms in spaced apart configuration; and a table mounted on sliding carriages supported by said arms.

9. An apparatus according to claim 8, wherein said support arms, table and spreading bar all pivot together under the action of said pivoting device.

10. An apparatus according to claim 1, wherein the trimming table station and the slitting table station are separated by one or more conveyors.

11. An apparatus according to claim 10, wherein there are two conveyors positioned between the trimming table station and the slitting table station; and wherein an aperture in a barrier wall is located between said conveyors to configure the slitting table and hopper stations in a hygienic processing area.

12. An apparatus according to claim 10, wherein there is one conveyor and the one conveyor is driven by a pneumatically operated motor.

13. The apparatus according to claim 10, wherein there are two or more conveyors and the two or more conveyors are driven by pneumatically operated motors.

14. An apparatus according to claim 1, wherein the outer layer cutter and transverse slitting blade device are driven by pneumatically operated motors.

* * * * *